United States Patent [19]

Norris

[11] Patent Number: 4,710,849

[45] Date of Patent: Dec. 1, 1987

[54] HIGH VOLTAGE CONTROL

[75] Inventor: Alan J. Norris, Cleveland, England

[73] Assignee: Imperial Chemical Industries, PlC, London, England

[21] Appl. No.: 752,623

[22] Filed: Jul. 8, 1985

[51] Int. Cl.[4] ..... B05B 5/02

[52] U.S. Cl. ..... 361/228; 361/235; 239/690

[58] Field of Search ..... 361/225–228, 361/235; 55/152, 128, 101, 103, 105; 239/697, 698, 706, 707, 690

[56] References Cited

U.S. PATENT DOCUMENTS 4,356,528 10/1982 Coffee ..... 361/228 X
4,561,037 12/1985 MacLaine et al. ..... 361/235 X

OTHER PUBLICATIONS

"Corona Discharge", McGraw-Hill Encycopedia of Science and Technology, McGraw-Hill Inc., N.Y., N.Y. ©1966, vol. 3, pp. 486–487.

"Breakdown and Breakdown Potential", vol. 2, p. 324, ibid.

*Primary Examiner*—L. T. Hix
*Assistant Examiner*—D. Rutledge
*Attorney, Agent, or Firm*—Cushman, Darby & Cushman

[57] ABSTRACT

Control of high voltage is effected using apparatus having a high impedance generator, the output being connected to a first member of low radius of curvature and a second member. The two members are spaced apart by a gas gap so that when the voltage between them exceeds a threshold value corona discharge across the gas can occur. Such apparatus is particularly useful in controlling voltage and hence the size and size distribution of liquid droplets in electrostatic spraying apparatus.

15 Claims, 3 Drawing Figures

HIGH VOLTAGE CONTROL

BACKGROUND OF THE INVENTION

This invention relates to the control of the magnitude of high voltages, e.g. voltage above 3 k V, for example above 5 kV and for example above 10 kV.

For some applications, e.g. electrostatic spraying of liquids, a high voltage/low current source is required. Typically a generator givine 20 kV at a load of 1 μA may be desired.

Simple, relatively low cost, high voltage generators generally have, inter alia for safety reasons, a high internal impedance which gives rise to poor regulation of the output voltage with changes in the load current. For example generators employing the use of a piezoelectric crystal or step-up transformer.

SUMMARY OF THE INVENTION

We have devised a simple way of improving the regulation based on the principles well recognized for voltage statilization of lower voltage/higher current systems. Thus voltage regulation has heretofore been utilized employing neon discharge tubes. In those regulators conduction through the tube is by virtue of ionization of a gas at such a pressure that the means free path of the ions is of the same order, or greater than, the spacing between the electrodes to which the voltage is applied. In the present invention however regulation of much high er voltages and lower currents is achieved by the use of corona discharge currents to effect the regulation.

Accordingly the present invention provides apparatus comprising a high impedance generator capable of producing an on-load voltage in an excess of 3 kV and a first member having a low radius of curvature spaced from a second member by a gas gap, said first and second members being respectively connected to the generator output, said first member being spaced from said second member by such a spacing that when the voltage between said first and second members exceeds a threshold value, corona discharge across said gap can occur.

By high impedance suitably is meant greater than $1\times10^9$ohms. The on-load voltage is in excess of 3 kV, for example in an excess of 5 kV and for example in excess of 10 kV.

DETAILED DESCRIPTION OF THE PREFERRED EMBODIMENT

Figure 1:
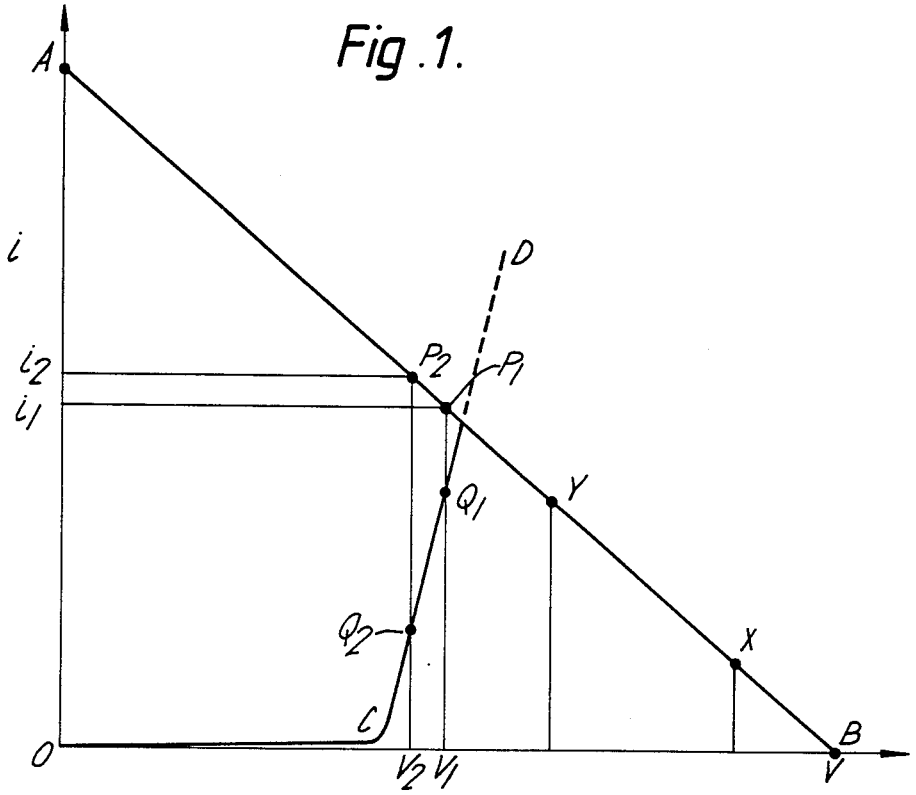
FIG. 1 is a graph showing current plotted against generator output voltage.

FIG. 1 of the accompanying drawings is a graph showing current plotted against the generator output voltage.

The line AB represents the generator load line: it is here shown as a straight line but it will be appreciated that in practice some departure from linearity may occur. The line OCD represents the characteristic of the current flowing through the gap between the first and second members. Below a threshold voltage E, there is virtually no current across the gap while at higher voltages the current rises very steeply.

Points $P_1$ and $P_2$ represent points on the load line AB at which the currents are $i_2$ and $i_2$, and the generator output voltages are $V_1$ and $V_2$ respectively, and the points $Q_1$ and $Q_2$ represent the points where the perpendiculars $P_1V_1$ and $P_2V_2$ from points $P_1$ and $P_2$ to line OB respectively intersect line OCD.

For the conditions represented by $P_1$, the current through the load corresponds to the distance $P_1Q_1$ while the current through the gap corresponds to the distance $Q_1V_1$. Likewise for the conditions represented by $P_2$, the load and gap currents are respectively represented by distances $P_2Q_2$ and $Q_2V_2$.

It is seen that a significant increase in the load current can thus be accommodated with only a small change in the output voltage, i.e. good regulation can be achieved. In the absence of a gap across which the corona discharge can take place, the points on the load line corresponding to load currents of the same magnitude $P_1Q_1$ and $P_2Q_2$ would be points X and Y respectively, and thus would correspond to a much larger change in output voltage.

The internal impedance of the generator is preferably sufficient that the current through the gap between the first and second members is insufficient to produce a spark discharge.

The shape of the first and second members and the gap therebetween is preferably such that the threshold voltage E is above 3 kV and for example above 5 kV.

The system is of particular utility where the maximum current that can be suplied by the generator is below 100 μA.

In a preferred embodiment, the gap between the first and second members can be modified so that the threshold voltage can be varied. This therefore provides a simple method of varying the voltage output of a high impedance high voltage generator, particularly where the load is liable to variation: in such cases a simple potentiometric voltage divider would be unsuitable for voltage variation because of the high internal impedance of the generator.

The first member has a low radius of curvature, preferably below 2 mm, and in particular below 0.5 mm. Preferably the first member has a needle configuration. The second member may be a plate or body of a suitable component of the apparatus, alternatively it may be a member of small radius of curvature.

The first and second members may in some cases be enclosed within a suitable envelope so that the humidity and pressure of the gas can be controlled. The gas is preferably air or nitrogen and is preferably at atmospheric or superatmospheric pressure.

Modification of the threshold voltage value can be achieved by varying the spacing between the first and second members and/or by interposing an insulating material between the first and second members: the amount by which the isulant obscures the direct path from the first to the second member will affect the threshold voltage.

The present invention is of particular utility in an electrostatic spraying device where a liquid is delivered to a spray nozzle whereat it is subject to the atomising electrostatic field. Thus in a further aspect the present invention provides an apparatus for spraying liquid comprising:

(i) a dispensing member having a spray nozzle, (ii) means for suppying liquid to said nozzle, (iii) a high voltage generator capable of producing an on-load voltage in an excess of 3 kV.

(iv) means for applying a potential difference between said dispensing member and an earth (grounded) surface so that an electrical field of sufficient strength is provided at said nozzle to atomize said liquid as a spray of electrically charged droplets, (v) a first member having a low radius of curvature spaced from said dispensing member by a gas gap, said first and dispensing members being respectively connected to the generator output, said first member being spaced from said dispensing member by such a spacing that when the voltage between said first and dispensing members exceeds a threshold value, corona discharge across said gap can occur.

Suitable dispensing members for liquid, spray nozzles, supplying means for liquid and means for applying a potential difference are as known in the art, for example see the disclosures of U.S. Pat. No. 4,356,528 and EP-A-120633.

The transfer of charge from the spray nozzle to the liquid forming the spray represents the load current. The rate of delivery of the liquid, and the applied voltage affect the size, and the size distribution of the liquid droplets formed by the electrostatic atomization. In many cases, for any given liquid, there may be an optimum droplet size, or size distribution, for the intended use.

For example, when spraying plants with a pesticide formulation, if the droplets are too large, the amount of "wrap-round", giving coating on the underside of plant leaves, is reduced; whereas if the droplets are too small, they are liable to be unduly affected by factors such as wind strength and so may drift onto plants other than those intended and/or on to the operator.

The rate of delivery of the liquid can be affected by a number of factors, e.g. the temperature, and so to compensate therefor to control the droplet size, it is desirable to be able to vary the voltage.

Furthermore variation in the liquid flow rate may affect the load current: hence if the regulation is poor, the applied voltage may be liable to considerable variation with consequent modification of the droplet size or size distribution.

In some cases the applied voltage may also affect the shape of the spray: consequently if it is desired to modify the spray shape, e.g. when the apparatus is used for electrostatic spraying paints or inks, for example as described in our European patent application No. 84.301502.5, published as EP-A-120633, variation of the voltage, by modification of the gap between the first and second members, may be desirable.

The invention is further described with reference to FIG. 2 which is a circuit diagram of a battery powered electrostatic spraying apparatus.

The generator, consisting of the components within the box 1, is powered by a dry battery train 2, via an on/off switch 3. The generator comprises a conventional transistorized saturization oscillator formed by the primary 4 of a first step-up transformer 5, resistor 6, and a transistor 7. Typically this oscillator has a frequency of the order of 10 to 100 kHz. The secondary of transformer 6 is connected, via a diode 8, to a capacitor 9. Connected in parallel with capacitor 9 is a gas-gap discharge tube 10 connected in series with the primary of an output step-up transformer 11. The secondary of output transformer 11 is connected, via a rectifier 12, to the "high voltage" output terminal 13 of the generator. The other output connection 14 is common with the input connection to the switch 3.

The high voltage output is connected via an insulated lead 15 to the casing of a cartridge 16 of the liquid to be sprayed. This cartridge has a spray nozzle 17 to which the high voltage applied to the cartridge casing is conducted either directly through the material of the casing and nozzle or via conduction through the liquid within cartridge 16.

Surrounding the nozzle 17 but insulated and spaced therefrom is a ring electrode 18 which is connected, via lead 19 to the common input/output terminal 14 of generator 1 via switch 3. The apparatus is arranged so that, in use, the common input/output terminal 14, and hence electrode 18 is earther via conduction through the operator. The earthed electrode 18 acts as a field adjusting electrode as described in U.S. Pat. No. 4,356,528. Shown dotted in the high voltage output circuit is a capacitor 20. This capacitor need not be a discrete component, but may be formed by the capacitance between the high voltage lead 15, the cartridge 16, and the nozzle 17 and the "earthed" components, e.g. lead 19, and the electrode 18, for example as described in EP-A-132062. To ensure that the capacitor 20 has a suitable value, typically 20–40 pF, leads 15 and 19 may be in close proximity, e.g. twisted together.

Connected to lead 19 is a pointed needle 21 whose end is spaced from the surface of cartridge 16. Needle 21 thus provides the "first member" and cartridge 16 the "second member" or dispensing member. Means, not shown, are provided to vary the spacing between the tip of needle 21 and the surface of cartridge 16.

In operation the saturation oscillator gives rise to current pulses in the secondary of transformer 5 which charge capacitor 9 via diode 8. When the voltage across capacitor 9 reaches the striking voltage of gas-gap discharge tube 10, the latter conducts, discharging capacitor 9 through the primary of output transformer 11, until the voltage across the gas-gap discharge tube falls to the extinguishing voltage. Typically the striking voltage is 150–250 V and the extinguishing voltage is less than 10 V.

The discharge of capacitor 9 through the primary of transformer 11 produces high voltage pulses in the secondary thereof: these high voltage pulses charge capacitor 20 via rectifier 12 and thus maintain a sufficiently high potential between nozzle 17 and the field adjusting electrode 18 for electrostatic atomization the liquid from nozzle 17.

The frequency with which the high voltage pulses are produced is determined by the value of capacitor 9, the impedance of the secondary of transformer 5 and the magnitude and frequency of the pulses produced by the saturation oscillator.

Variation of the spacing between needle 21 and cartridge 16 varies the threshold voltage for corona discharge between cartridges 16 and needle 2, and hence, in the manner described hereinbefore, provides regulation and control of the voltage applied to nozzle 17.

No corona discharge occurs between the nozzle 17 and electrode 18 because the field strength is insufficient, indeed corona discharge between nozzle 17 and electrode 18 would be undesirable since it would interfere with the atomization the liquid at nozzle 17. Thus the radius of curvature of the nozzle 17 and electrode 18, and the spacing of nozzle 17 from electrode 18 are such that the threshold voltage for corona discharge across the gap between nozzle 17 and electrode 18 is above the maximum voltage that can be applied by the generator 1 to nozzle 17.

Figure 2:
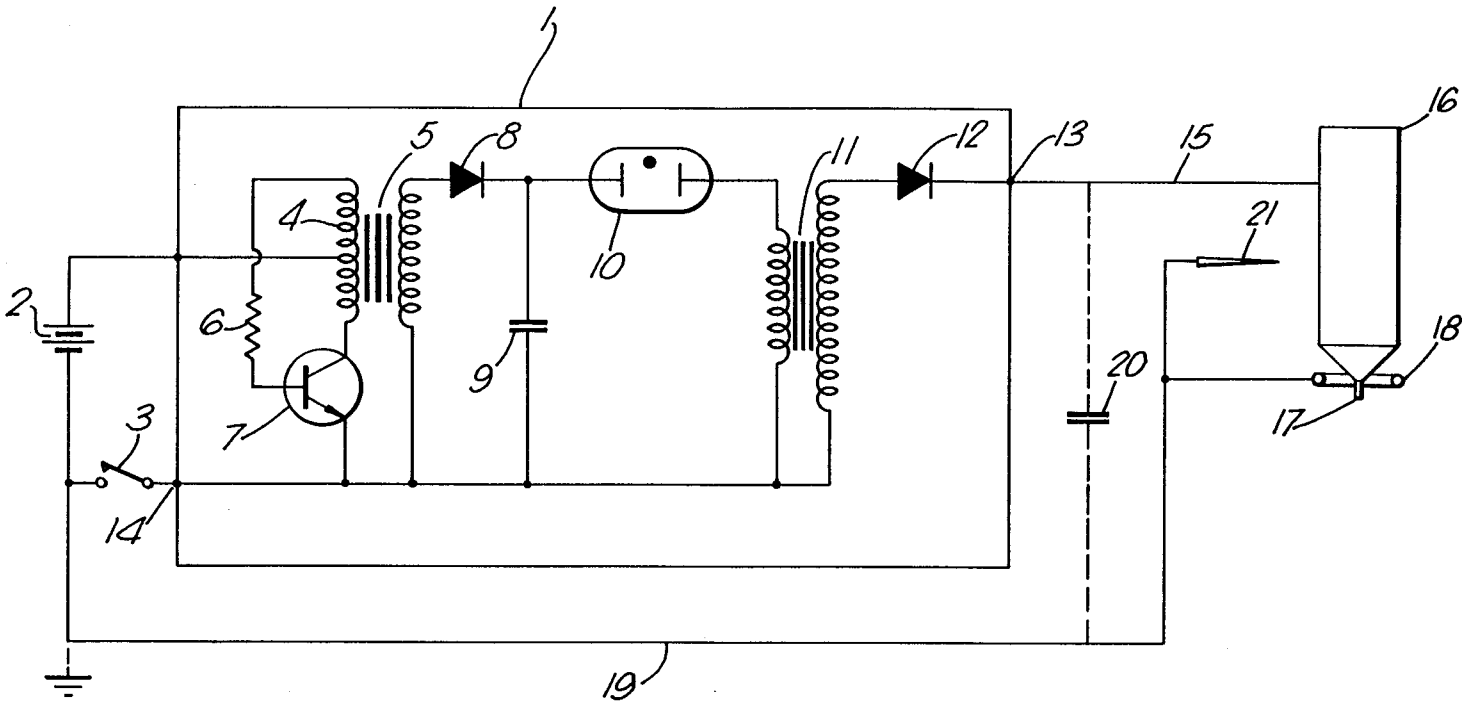
FIG. 2 is a circuit diagram according to a preferred embodiment.

In an example a pesticide composition of resistivity $8\times10^7$ ohm-cm was sprayed at a liquid flow rate of 1 ml/minute using apparatus of the type shown in FIG. 2 using a generator giving the high voltage pulses at a frequency of about 25 Hz. The capacitance of capacitor 20 was about 20 pF and primarily formed by the capacitance between leads 15 and 19 which were each about 0.9 m long. The series train of batteries 2 gave a voltage of 3.1 V and the current drain thereon was about 150 mA.

At a spacing of needle 21 from cartridge 16 of 4 cm the voltage at the nozzle 17 was about 15 kV whereas when the spacing was reduced to 2.5 cm the voltage was reduced to about 10 kV. The load current, i.e. the current corresponding to the transfer of charge to the liquid as it is electrostatically atomized, was about 200 nA.

Figure 3:
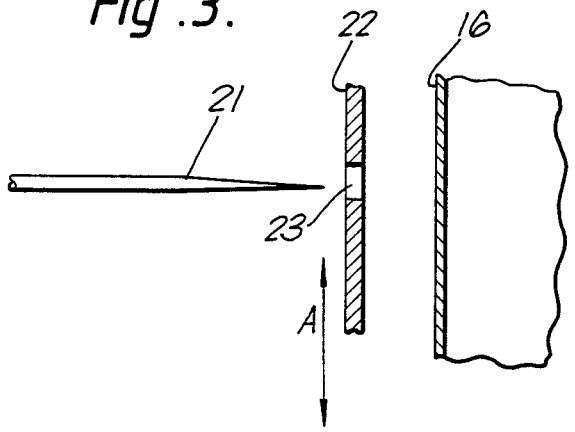
FIG. 3 is a diagrammatic section in part of a preferred embodiment.

In a modification shown in FIG. 3, which is a diagrammatic section of part of the apparatus, needle 21 is held in fixed relationship to cartirdge 16. An insulating member 22, e.g. a polymethyl methacrylate sheet, provided with an opening 23 therein constituting a window is positioned between needle 21 and cartridge 16. Member 22 is moveable in the direction of arrows A. When window 23 is symmetrically disposed about the end of needle 21, i.e. as shown in FIG. 3; the insulating member 33 offers little obstruction to the corona discharge between the tip of needle 21 and cartridge 16. However movement of the insulating member 22 in the direction of the arrows A causes the insulating member 22 to obstruct the corona discharge, hence increasing the threshold voltage.

I claim:

1. Apparatus comprising:

a high impedance generator capable of producing an on-load voltage in an excess of 3 kV;

spray dispenser means having a nozzle and coupled to said generator, for dispensing spray;

field adjustment electrode means coupled to ground and spaced from said nozzle to cause electrostatic charging of said spray leaving said nozzle; and a first member having a low radius of curvature spaced from said dispenser by a gas gap, said member being coupled to the generator output, said member being spaced from said dispenser by such a spacing that when the voltage between said member and said dispenser exceeds a threshold value, corona discharge across said gap can occur to prevent corona discharge between said nozzle and said field adjustment electrode means.

2. Apparatus according to claim 1 having means for varying the threshold voltage vlue between said member and said dispenser.

3. Apparatus according to claim 2 having means for modification of the gas gap between the member and said dispenser the threshold voltage value.

4. Apparatus according to claim 3 having means for altering the spacing between the member and said dispenser to achieve the variation of the threshold voltage value.

5. Apparatus according to claim 3 having means for at least partially interposing an insulating material between the member and said dispenser to achieve the variation of the threshold voltage value.

6. Apparatus according to claim 1 wherein the threshold voltage is above 5 kV.

7. Apparatus according to claim 1 wherein the member has a radius of curvature below 2 mm.

8. Apparatus according to claim 7 wherein the member has a needle configuration.

9. Apparatus for spraying liquid comprising:

(i) a dispensing member having a spray nozzle, (ii) means for supplying liquid to said nozzle, (iii) a high impedance voltage generator capable of producing an on-load voltage in an excess of 3 kV, (iv) means for applying a potential difference between said dispensing member and an earthed surface so that an electrical field of sufficient strength is provided at said nozzle to atomize said liquid as a spray of electrically charged droplets without corona discharge between said dispenser and said earthed surface, and (v) a first member having a low radius of curvature spaced from said dispensing member by a gas gap, said first and dispensing members being respectively connected to the generator output, said first member being spaced from said dispensing member by such a spacing that when the voltage between said first and dispensing members exceeds a threshold value, corona discharge across said gap can occur preventing corona discharge between said dispenser and said earthed surface.

10. Electrostatic spraying apparatus, comprising:

high impedance generator means for producing a high voltage;

spray dispenser means having a nozzle and coupled to said generator means, for dispensing spray;

field adjustment electrode means coupled to ground and spaced from said nozzle to cause electrostatic charging of said spray leaving said nozzle; and discharge electrode means coupled to ground and spaced from said dispenser means by a distance to cause corona discharge between said discharge electrode means and said dispenser means when said high voltage exceeds a threshold value to preent corona discharge between said nozzle and said field adjustment electrode means.

11. Apparatus according to claim 10 further including means for regulating said corona discharge between said discharge electrode means and said dispenser means.

12. Apparatus according to claim 11 wherein said corona discharge regulating means includes insulating material disposed between said discharge electrode means and said dispenser.

13. Apparatus according to claim 12 wherein said discharge electrode means comprises a needle electrode, and wherein said insulating material has a hole disposed between said needle electrode and said dispenser means.

14. Apparatus according to claim 13 wherein said corona discharge regulating means regulates said corona discharge by adjusting a location of said hole.

15. Apparatus according to claim 14 wherein said corona discharge regulating means includes means for moving said hole in a direction substantially perpendicular to a line between said needle electrode and said dispenser.

* * * * *